US007287505B2

(12) United States Patent
Kruse et al.

(10) Patent No.: US 7,287,505 B2
(45) Date of Patent: Oct. 30, 2007

(54) STARTING DEVICE FOR INTERNAL COMBUSTION ENGINE

(75) Inventors: Olaf Kruse, Glinde (DE); Klemens Krahn, Norderstedt (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/554,706

(22) Filed: Oct. 31, 2006

(65) Prior Publication Data

US 2007/0056547 A1 Mar. 15, 2007

Related U.S. Application Data

(63) Continuation-in-part of application No. 10/761,856, filed on Jan. 20, 2004, now abandoned.

(30) Foreign Application Priority Data

Jan. 29, 2003 (DE) ..... 203 01 181 U
Dec. 19, 2003 (DE) ..... 203 19 902 U

(51) Int. Cl.
*F02N 3/02* (2006.01)

(52) U.S. Cl. ..... 123/185.3

(58) Field of Classification Search ..... 123/185.14, 123/185.2, 185.3, 185.4
See application file for complete search history.

(56) References Cited

U.S. PATENT DOCUMENTS

| | | | | |
|---|---|---|---|---|
| 2,460,420 | A | 2/1949 | Kincannon | |
| 2,511,908 | A | 6/1950 | Forbess | |
| 3,375,814 | A | 4/1968 | Hamman | |
| 5,287,832 | A | 2/1994 | Uhl | |
| 6,588,390 | B2 | 7/2003 | Kawasaki et al. | |
| 6,755,170 | B2 * | 6/2004 | Morishige et al. | 123/185.3 |
| 6,782,863 | B2 | 8/2004 | Leasure et al. | |
| 6,971,359 | B2 * | 12/2005 | Tohyama | 123/185.3 |
| 6,981,482 | B2 * | 1/2006 | Tsunoda et al. | 123/185.3 |
| 7,028,658 | B2 * | 4/2006 | Kruse et al. | 123/185.3 |
| 7,069,896 | B2 * | 7/2006 | Tsunoda et al. | 123/185.3 |
| 7,093,577 | B2 * | 8/2006 | Tohyama | 123/185.3 |
| 7,174,874 | B2 * | 2/2007 | Horikoshi | 123/185.3 |
| 2003/0213455 | A1 * | 11/2003 | Tohyama | 123/185.3 |

FOREIGN PATENT DOCUMENTS

EP 1 365 143 A1 11/2003

* cited by examiner

*Primary Examiner*—Stephen K. Cronin
*Assistant Examiner*—Arnold Castro
(74) *Attorney, Agent, or Firm*—Kelly Lowry & Kelley LLP

(57) ABSTRACT

In order to improve a pull-rope type starting device (100) for an one internal combustion engine, having at least one rope drum (4) which is rotatably held in a housing (1), wherein said starting device, for generating the drive torque for the motor shaft by means of a starter handle, is rotatable by way of a starter rope or pull-rope, and by way of an elastic coupling element (6) connected to a ratchet-type engaging element, by means of which the drive torque can be transmitted to the motor shaft, such that the elastic coupling element (6) or a part thereof can simply, effectively and reliably be prevented from entering a design-related gap between the rope drum (4) and the engaging element (5), it is proposed that a bushing or sleeve (8) be provided in this gap.

20 Claims, 8 Drawing Sheets

STARTING DEVICE FOR INTERNAL COMBUSTION ENGINE

BACKGROUND OF THE INVENTION

The present invention relates to a starting device for an internal combustion engine, in particular a pull-rope type starting device for at least one two-stroke or four-stroke motor.

In the past, the operation of a starting device for an internal combustion engine, in particular of a pull-rope type starting device for a two-stroke or four-stroke motor, has often caused problems because during the starting process the compression in the internal combustion engine periodically leads to high reaction forces occurring as a result of which changing and temporarily very considerable forces act on the hand of the operator.

The load peaks which occur at the handle, in particular at the starter handle or pull handle of the starting device, are accordingly larger, the lighter the rotating mass of the internal combustion engine. In concrete terms this means that the torque to be produced at the motor shaft is subject to considerable fluctuations, because in the compression phase of the piston, up to the dead centre, a very considerable torque is to be produced, while in the expansion phase, the torque to be produced drops considerably, at times even dropping to zero.

In order to reduce transfer of these particularly strong reaction forces, which are caused as a result of the compression in the internal combustion engine, on the handle of the starting device, thus facilitating the starting process, printed publication DE-P 41 35 405 A1, which discloses a starting device of the type mentioned in the introduction, proposes that the fluctuations in the torque which has to be produced at the motor shaft be elastically cushioned.

To this effect, an elastic element is coupled between the pulley or rope drum associated with the load transfer means of the handle, in particular the starter rope or pull rope, and the engaging element, in particular the ratchet-type engaging element, of the crankshaft. By means of said elastic member, the pull movement during the starting process, which pull movement is transferred by the handle and the load transfer means, is somewhat freed of the above-mentioned fluctuations, or, in an ideal case, is completely freed. (An earlier attempt to design the load transfer means so as to be elastic itself led to unsatisfactory results.)

Probably the earliest proposal concerning an in-line arrangement of such an elastic coupling element is contained in the Japanese printed specification for a utility model Y-H616964 (Starting Industrial Co., Ltd.). The European patent application EP 1 203 883 A2 contains a newer proposal submitted by the same applicant.

Furthermore, a proposal was recently developed in which, during starting, the elastic coupling element, which is designed as a spiral spring, is rotated by an angle of rotation of approximately 270 degrees to approximately 280 degrees, which provides good starting characteristics. When this maximum angle of rotation has been reached, the spiral spring places itself against the shaft, due to becoming smaller as a result of rotation. This placement of the spiral spring against the shaft results in a blockage of any further rotation so that the engaging element of the crankshaft is forced to rotate with the pulley or rope drum.

However, in practical application, this design (such as the light-start system supplied by Starting Industrial Co., Ltd., according to the so-called coil-spring principle) has been associated with disadvantages in that there is a design-related gap between the pulley or rope drum and the engaging element, with said design-related gap being defined by the longitudinal tolerance of three components, and with said design-related gap being difficult to achieve in the required quality in series production.

Consequently, due to the operating principle of the spiral spring which—blocking any further rotary movement beyond approximately 270 degrees to approximately 280 degrees—places itself around the bearing axles, a coil of this spiral spring is pushed on one side into the gap or interspace between the pulley or rope drum and the (ratchet-type) engaging element, because the spiral spring has to absorb the entire force of the load transfer means, i.e. the entire force of the pull rope.

This is illustrated in FIG. 1, wherein a rope drum 4 is rotatably held in a housing 1. When the rope drum 4 is made to rotate by the starter rope or pull rope 9 being pulled, such as by means of a starter handle (not shown in FIG. 1) to generate the drive torque for a motor shaft. When this occurs, the elastic coupling element, in the form of a spiral spring 6, compresses around an axle of the rope drum 4 and an axle of the engaging element 5. However, due to a gap 18 between these axles, the coil spring 6 is pushed into the gap or interspace between the rope drum and the engaging element, such as is illustrated in FIG. 1. It will be appreciated by those skilled in the art that the spring 6 illustrated in FIG. 1 is only partially impinging upon the gap 18, and that, in fact, a portion of the spring 6 can become completely lodged within the gap 18 between the rope drum 4 and the engaging element 5.

In conclusion, this means that when a specific tolerance dimension is exceeded, at least part of a coil of the spiral spring 6 enters the gap 18 between the pulley or rope drum 4 and the engaging elements 5 which are connected by the spiral spring 6, thus naturally becoming overstretched and sustaining permanent deformation. As a result of this, the system ceases to function properly and blocks.

Furthermore, it must be considered that during each starting process the elastic coupling element, which is a spiral spring, comes to rest on the shaft (angular limitation of the system to approximately 270 degrees to approximately 280 degrees), and that the forces of the pull rope which are required for overcoming the compression force are only transmitted by way of the spiral spring. In extreme cases this can result in the spiral spring breaking so that the starting device ceases to function and the internal combustion engine can no longer be started at all.

It is also possible for fragments of the broken spiral spring to damage adjacent components of the starting device.

Accordingly, there is a continuing need for a pull-rope starting device for an internal combustion engine which prevents the elastic coupling element (coil spring) from entering the gap between the rope drum and engaging element. The present invention fulfills this need, and provides other related advantages.

SUMMARY OF THE INVENTION

Starting from the above-mentioned disadvantages and shortcomings, and acknowledging the state of the art as outlined above, it is the object of the present invention to improve a starting device of the type mentioned in the introduction such that the elastic coupling element or a part thereof can simply, effectively and reliably be prevented from entering the design-related gap between the pulley or rope drum and the engaging element.

This object is met by a starting device with the characteristics stated in claim 1. Advantageous embodiments and expedient improvements of the present invention are provided in the subordinate claims.

According to the teaching of the present invention, the gap between the pulley or rope drum, in particular between the axle of the pulley or rope drum, and the coupling element and/or between the pulley or rope drum, in particular the axle of the pulley or rope drum, and the engaging element, in particular the axle of the engaging element comprises at least one bushing or sleeve, in particular a thin-walled bushing or sleeve, by means of which this gap can at least partly be filled. As a result of this, the elastic coupling element or a part thereof can simply, effectively and reliably be prevented from entering the design-related gap between the pulley or rope drum and the engaging element.

In other words, this means that the present invention proposes that the problem of the elastic coupling element, which preferably is a spiral spring, breaking as a result of a coil of the spiral spring entering the separation joint between the pulley (rope drum) and the engaging element be solved by inserting a simple bushing or sleeve.

This proposal is as simple as it is reliable and effective, since the bushing or sleeve, which is preferably in the shape of a hollow cylinder, can be put over the two opposite shaft ends without any problem so that any deformation of the spring which is used is safely prevented.

Accordingly, when the starting device according to the present invention is activated, in other words when the handle is pulled, the elastic coupling element, i.e. the spring, now places itself around the bushing or sleeve, which in an advantageous way essentially extends along the entire length of the spring.

As a result of this, the required operating gap (design-related gap or design-related separation joint) between the axle of the pulley or rope drum and the axle of the (ratchet-type) engaging element no longer has any influence on the spring. As a result of this, the tolerances can be larger, which in turn makes it possible to produce the starting device more economically.

According to a particular inventive improvement, the bushing or sleeve is guided so as to be torsionally rigid on the axle of the pulley or rope drum, and/or has play in relation to the axle of the engaging element.

The present invention benefits from particularly favorable materials characteristics if the bushing or sleeve which is installed between the spring and the axle is a thin-walled, in particular hardened, metal bushing or metal sleeve.

According to a particularly inventive improvement of the present starting device the elastic coupling element, in particular the spiral spring, is pretensioned, i.e. comprises pretension, so that already at the very start of the rotary movement between the pulley or rope drum and the (ratchet-type) engaging element, force transferred by way of the elastic coupling element can start, or the forces which can be transmitted by way of the elastic coupling element can be greater because a region of the characteristic curve of the elastic coupling element, in particular of the spring characteristic curve, can be exploited, which region differs from that of the state of the art.

As a result of the above-described technical measures according to the present invention, the starting device which hitherto was only suitable with limitations, namely in the area of leisure and hobby applications, is now also useable for the professional market.

Furthermore, the present invention relates to a starting device for at least one internal combustion engine, in particular a pull-rope type starting device for at least one two-stroke or four-stroke motor, which comprises at least one pulley or rope drum which is rotatably held in at least one housing, wherein said starting device, for generating the drive torque for the motor shaft by means of at least one handle, in particular by means of at least one starter handle or pull handle, is rotatable by way of at least one load transfer means, in particular by way of at least one starter rope or pull-rope, and by way of at least one pretensioned elastic coupling element or an elastic coupling element comprising pretension, in particular by way of at least one spiral spring, is connected to at least one engaging element, in particular to at least one ratchet-type engaging element, by means of which the drive torque can be transmitted to the motor shaft.

Because the elastic coupling element, in particular the spiral spring, is pretensioned, or comprises pretension, already at the very start of the rotary movement between the pulley or rope drum and the (ratchet-type) engaging element, force transfer by way of the elastic coupling element can start, or the forces which can be transmitted by way of the elastic coupling element can be greater because a region of the characteristic curve of the elastic coupling element, in particular of the spring characteristic curve, can be exploited, which region differs from that of the state of the art.

Furthermore, the present invention relates to an internal combustion engine, in particular a two-stroke or four-stroke motor, comprising at least one starting device of the type described above.

Furthermore, the present invention relates to a work tool, in particular a portable hand tool powered by an internal combustion engine, such as for example a brush cutter, a chainsaw, a motor saw, an abrasive cutting-off machine or the like, comprising at least one internal combustion engine of the type described above, which internal combustion engine comprises at least one starting device of the type described above.

Finally, the present invention relates to the use of at least one starting device according to the type described above, comprising at least one internal combustion engine according to the type described above, for a work tool according to the type described above.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

As has already been explained above, there are various options to advantageously implement and improve the teaching of the present invention. Moreover, further embodiments, characteristics and advantages of the present invention are explained in detail below, with reference to the embodiments shown in FIGS. 1 to 8B.

The following are shown.

Identical or similar embodiments, elements or characteristics in FIGS. 1 to 8B are designated by means of identical reference characters.

LIST OF REFERENCE CHARACTERS

Figure 1:
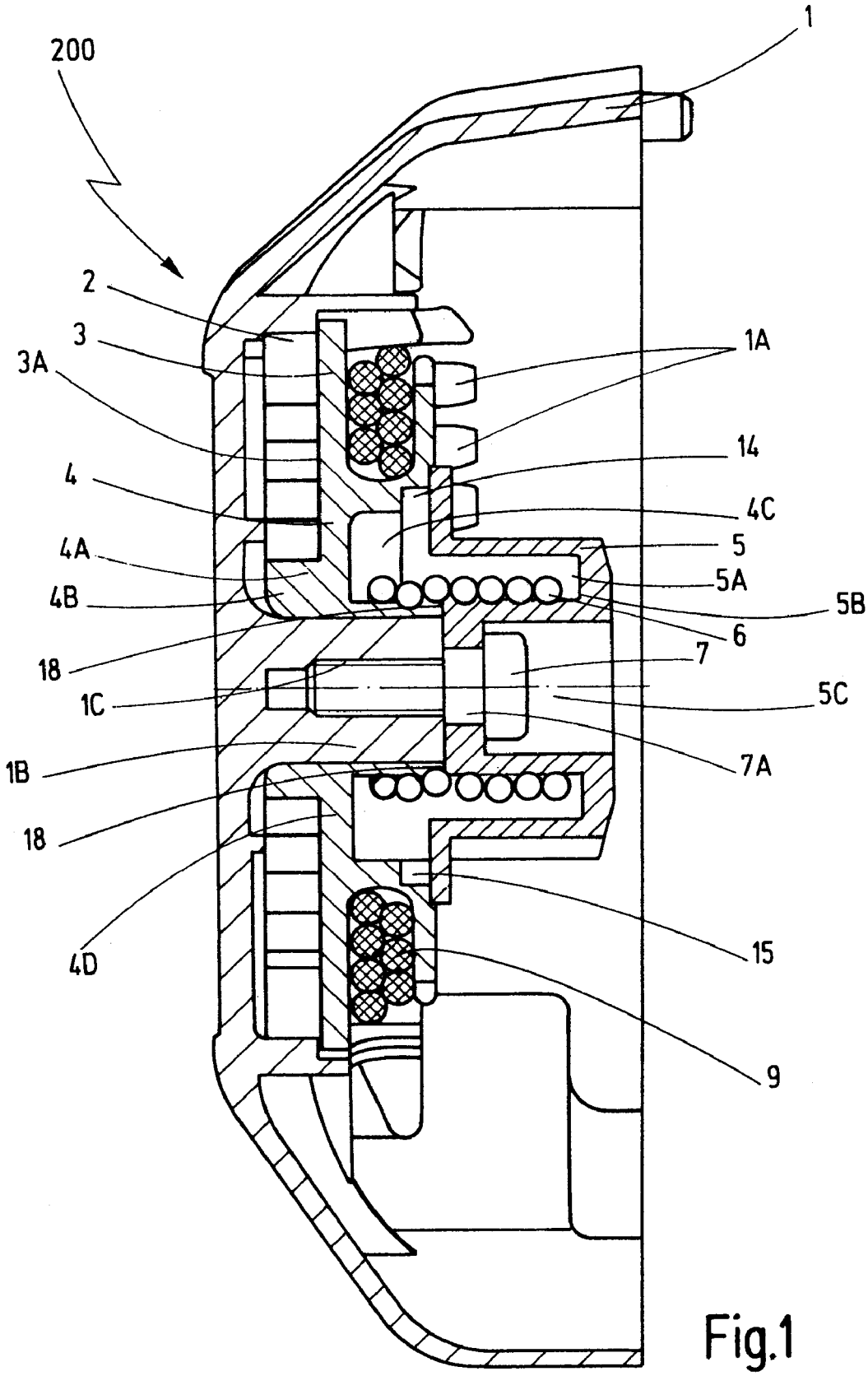
Fig.1 Prior Art
FIG. 1 is a diagrammatic section view of a prior art starting device.
Figure 2:
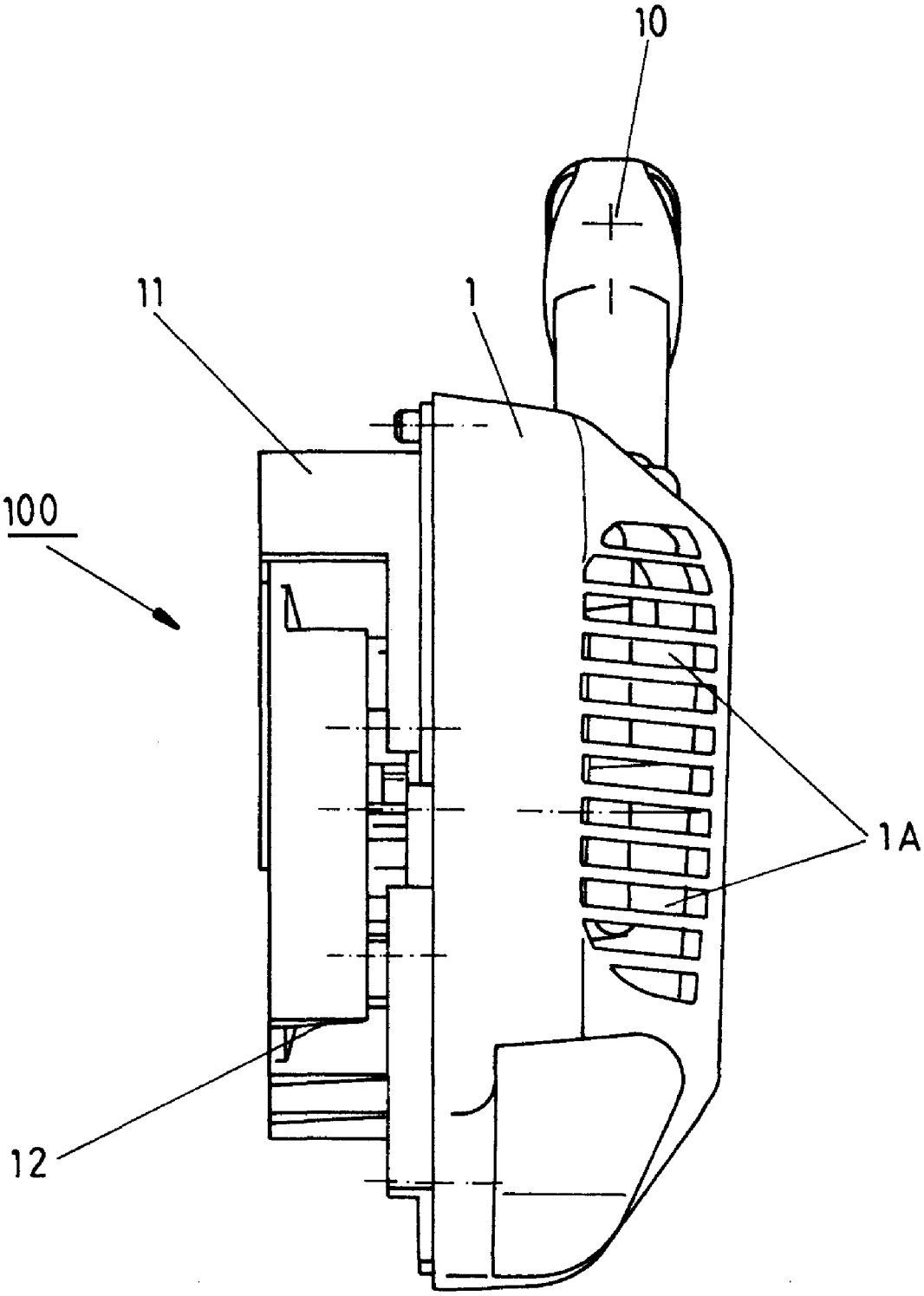
FIG. 2 is a diagrammatic front view of an embodiment of a starting device, accommodated in a housing, according to the present invention.
Figure 3:
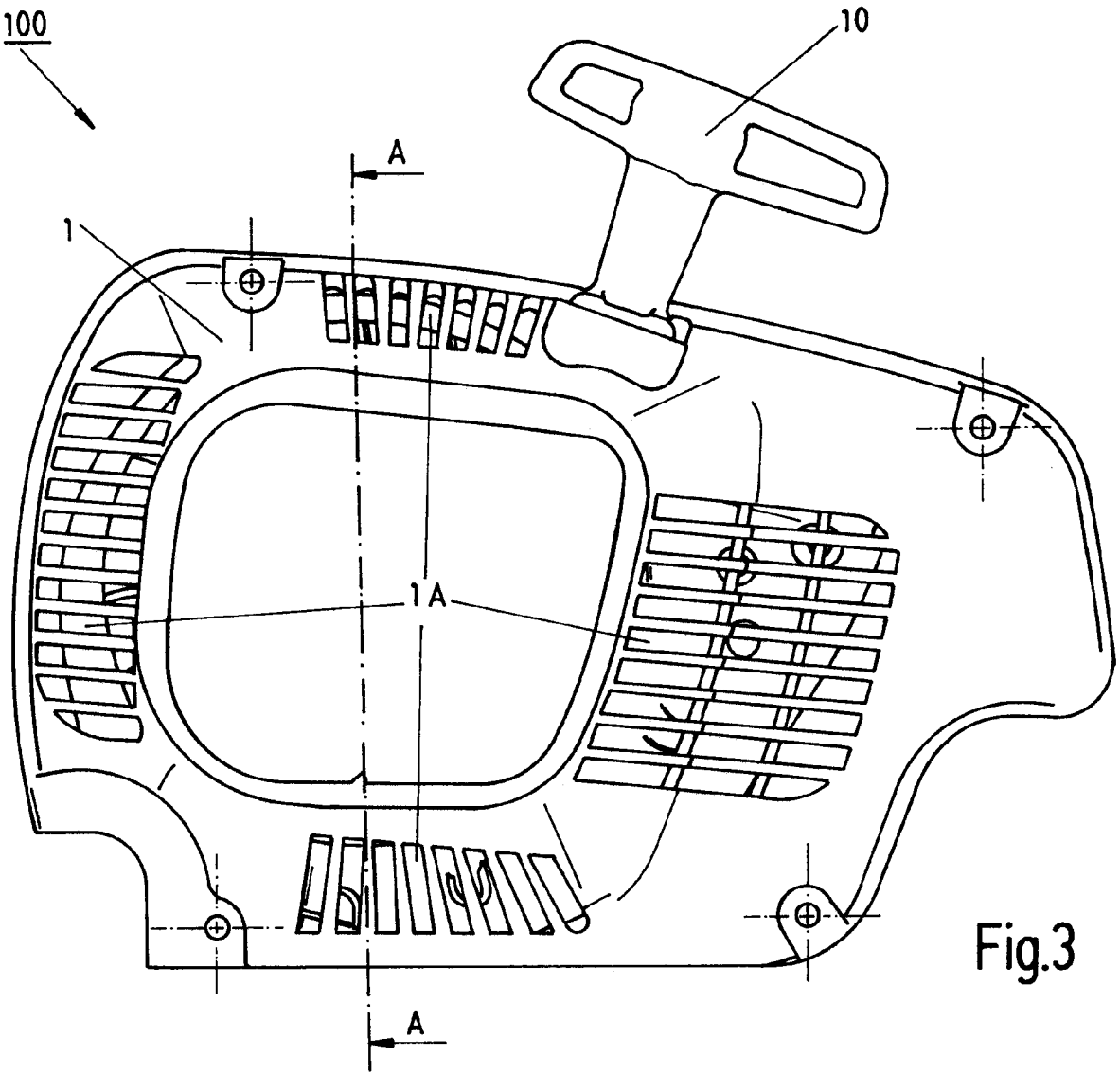
FIG. 3 is a diagrammatic side view of the starting device shown in FIG. 2 accommodated in a housing.

100/200 Starting device, in particular pull-rope type starting device

1 Housing, in particular fan housing

1A Ventilating slot in the housing 1

1B Bearing journal

1C Internal thread of the bearing journal 1B

2 Starter spring

3 Spring housing for starter spring 2

3A Disc, in particular metal disc

4 Pulley or rope drum

4A Journal of the pulley or rope drum 4

4B Axial slot of the journal 4A

4C Accommodation space of the pulley or rope drum 4

4D Face wall of the pulley or rope drum 4

4E Centre borehole of the pulley or rope drum 4

5 Engaging element, in particular ratchet-type engaging element

5A Accommodation space of the engaging element 5

5B Face wall of the engaging element 5

5C Centre borehole of the engaging element 5

6 Elastic coupling element, in particular spiral spring

7 Screw, in particular attachment screw

7A Shoulder of the screw 7

8 Bushing or sleeve

9 Load transfer means, in particular starter rope or pull rope

10 Handle, in particular starter handle or pull handle

11 Air duct

12 Recess

13 Limit stop, in particular first limit stop

13' Second limit stop

14 Guide groove for guiding the limit stop 13, in particular first guide groove for guiding the first limit stop 13

14' Second guide groove for guiding the second limit stop 13'

15 Rest surface for limit stop 13, in particular first rest surface for first limit stop 13

15' Second rest surface for second limit stop 13'

16 Slot in the face wall 4D

17 Recess in the face wall 5B

18 Gap between rope drum 4 and engaging element 5

PREFERRED EMBODIMENTS OF THE INVENTION

The pull-rope type starting device 100 according to FIGS. 2 to 8B is intended for manual starting of an internal combustion engine (two-stroke or four-stroke motor), which for example forms part of a motor chainsaw. The pull-rope type starting device 100 is accommodated in a housing 1 which both in the first embodiment according to FIGS. 2, 3, 4, 5A, 5B, 6A, 6B and in the second embodiment according to FIGS. 2, 3, 4, 7A, 7B, 8A, 8B is a removable cover, comprising ventilating slots 1A (compare FIGS. 2, 3 and 4) of the motor housing which among other things also comprises an air duct 11 as well as an essentially cylindrical recess 12.

The internal wall of the housing 1 (which internal wall is facing to the right in FIG. 4) comprises a bearing journal 1B which is surrounded by a spring housing 3, which is also essentially arranged so as to be fixed in the housing, for a spiral-shaped starter spring 2 which is clamped in on one side at the rim of the spring housing 3. This starter spring 2 is covered by a (metal) disc 3A towards a clutch drum (compare FIGS. 5A and 5B or alternatively FIGS. 7A and 7B) which clutch drum 4 is in the form of a pulley or rope drum 4; said starter spring 2 serves as a pull-back spring for the pulley or rope drum 4.

The pulley or rope drum 4 comprises a rear journal 4A (compare FIG. 4) which protrudes through a centre borehole of the (metal) disc 3A into the spring housing 3 and comprises an axial slot 4B for engagement of the inner end of the spiral-shaped starter spring 2.

Wound on the pulley or rope drum 4 is a starter rope or pull rope 9, as a load transfer means, with the free end of said starter rope or pull rope 9 leading out of the housing 1 and being attached to a handle 10, namely to a starter handle or pull handle. By pulling the starter rope or pull rope 9 by means of the handle 10, the pulley or rope drum 4 is made to rotate on the bearing journal 1B as a result of the starter rope or pull rope 9 unwinding.

The pulley or rope drum 4 comprises a ring-shaped accommodation space 4C which surrounds the bearing journal 1B, with said accommodation space 4C towards the starter spring 2 being delimited by a face wall 4D. An elastically deformable coupling element 6 in the form of a spiral spring is arranged between this face wall 4D of the pulley or rope drum 4 and a ring-shaped accommodation space 5A of a ratchet-type engaging element 5.

The outer end, i.e. the end of the face wall 4D which faces the pulley or rope drum 4, of the elastic coupling element 6 is hooked into a slot 16 (compare FIGS. 5A and 5B or alternatively FIGS. 7A and 7B), which slot has been provided in a ring-shaped shoulder of the face wall 4D. This shoulder encompasses the spiral-spring shaped coupling element 6 whose outer coil rests against the interior wall of the shoulder. The inner end, i.e. the end of the elastic coupling element 6 which points towards a face wall 5B of the ring-shaped accommodation space 5A of the ratchet-type engaging element 5 of the elastic coupling element 6, is hooked into a recess 17 (compare FIG. 6B or alternatively FIG. 8B) provided in the face wall 5B.

In the installed state of the starting device 100, the bearing journal 1B, which is arranged to as to be fixed in the housing, passes through a centre borehole 4E (compare FIGS. 5A and 5B or alternatively FIGS. 7A and 7B) of the face wall 4D of the pulley or rope drum 4 so that said centre borehole 4A forms a bushing-shaped accommodation space for the bearing journal 1B. An attachment screw 7 (compare FIG. 4) is screwed into an axial interior thread 1C (compare FIG. 4) of the bearing journal 1B. At the head of said attachment screw 7 there is a ring-shaped shoulder 7A (compare FIG. 4) by means of which the ratchet-type engaging element 5 is attached to the free end of the bearing journal 1B by way of a centre borehole 5C (compare FIGS. 4 and 6B or alternatively FIGS. 4 and 8B which provides an exact fit for the shoulder 7A of the attachment screw 7.

When the pulley or rope drum 4 is made to rotate by the starter rope or pull rope 9 being pulled, the pulley or rope drum 4 takes along the ratchet-type engaging element 5 by way of the elastic coupling element 6, because the pulley or rope drum 4 and the ratchet-type engaging element 5 are connected on a mutual axle by means of the elastic coupling element 6. By means of this ratchet-type engaging element 5, the rotary movement of the pulley or rope drum 4 and thus the torque can be transferred to the motor shaft to be driven.

Basically, when the motor shaft is driven or rotated, the compression in the internal combustion engine increases until the top dead-centre position of the piston has been reached, then it decreases. The reaction torque periodically fluctuates in accordance with the above, which in a conventional starting device is reflected in high load peaks which during starting, i.e. during activation of a conventional starting device, have to be provided. The above-described elastically is provided to compensate for these periodic changes in the force to be provided; in the two embodiments shown according to FIGS. 1 to 7B said deformable coupling element 6 is a spiral spring. 6.

This spiral spring 6 is dimensioned such that the ratchet-type engaging element 5 is taken along by the rotating pulley or rope drum 4, as long as the reaction torque of the motor shaft remains below a specified limiting value, wherein the piston of the internal combustion engine is located in the regions in front of and behind its dead centre position. When the reaction torque increases beyond this limiting value, the spiral spring 6 becomes deformed in that its coils are constricted so that the rotary speed of the ratchet-type engaging element 5 decreases, while the pulley or rope drum 4 can continue to rotate at the same rotary speed and at approximately the same expenditure of force.

Consequently, the pulley or rope drum 4 rotates additionally, relative to the ratchet-type engaging element 5 which has been inserted into the pulley or rope drum 4 with little play. The height of the spiral spring 6, which spiral spring 6 is made from flat steel strip, is such that the face wall 5B of the engaging element 5 does not permanently touch the spiral spring 6. Temporary contact of the spiral spring 6 with the face wall 5B of the engaging element 5 is possible. In this way, a safeguard against axial displacement of the coils of the spiral spring 6 is achieved.

Figure 4:
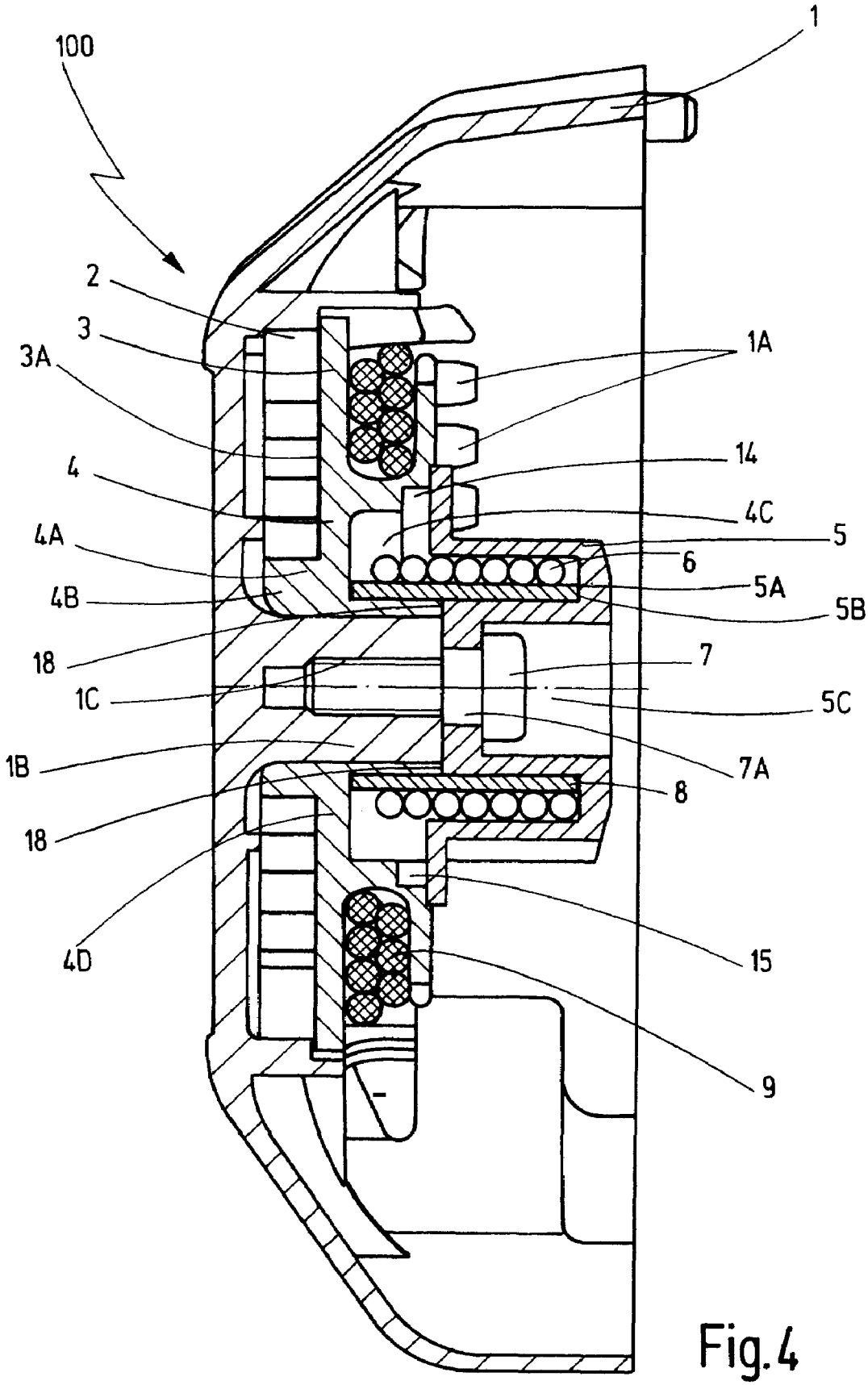
FIG. 4 is an enlarged diagrammatic section view of the starting device shown in FIGS. 2 and 3 along the sectional line A-A in FIG. 3.
Figure 5A:
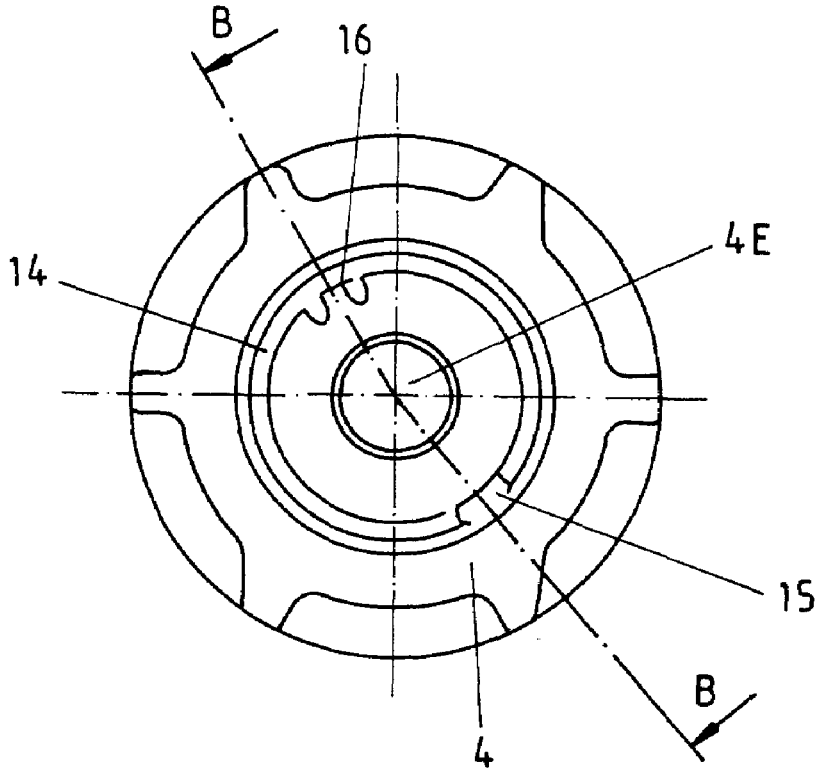
FIG. 5A is a diagrammatic top view of an embodiment of a pulley or rope drum according to the present invention, with said pulley or rope drum being associated with the starting device shown in FIGS. 2 to 4.
Figure 5B:
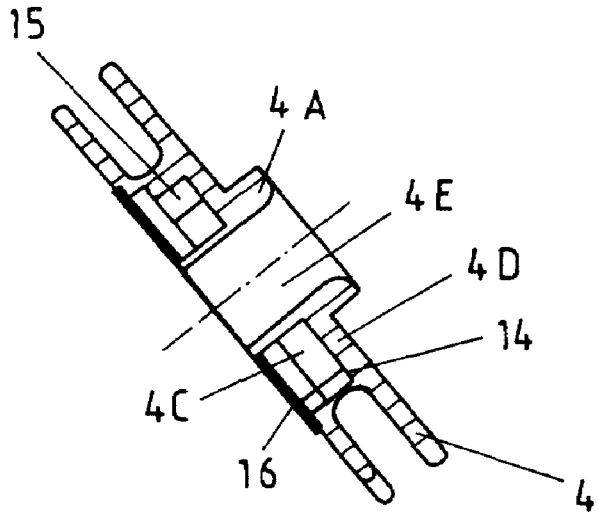
FIG. 5B is a diagrammatic section view of the pulley or rope drum shown in FIG. 4A along the sectional line B-B in FIG. 5A.

As can be seen from the sectional view according to FIG. 4, in the above-mentioned embodiment of the starting device 100 a design-related gap 18 results between the axle of the pulley or rope drum 4 and the axle of the ratchet-type engaging element 5, and consequently also between the axle of the pulley or rope drum 4 and the elastic coupling element 6.

In order to simply, effectively and reliably prevent a coil of the elastic coupling element 6 or part of a coil of the elastic coupling element 6 from entering this design-related gap 18 between the pulley or rope drum 4 and the ratchet-type engaging element 5, this gap 18 can be filled or covered by means of a thin-walled bushing or sleeve 8 in the shape of a hollow cylinder.

Consequently, by inserting the simple bushing or sleeve 8 in or over the design-related gap 18, any breaking of the elastic coupling element 6, which is designed as a spiral spring, as a result of a coil of the spiral spring 6 entering the separation joint between the pulley (rope drum 4) and the ratchet-type engaging element 5 can be prevented. The bushing or sleeve 8 is put over the two opposite shaft ends so that any deformation of the elastic coupling element 6, which is a spring, is safely prevented. More particularly, the bushing or sleeve 8 is placed between the spring 6 and the axles of the rope drum 4 and ratchet-type engaging element 5 such that the sleeve or bushing 8 extends over any gap 18 formed therebetween so that the spring 6 cannot enter into the gap 18.

Accordingly, when the starting device 100 is activated, i.e. when the handle 10 is pulled, the elastic coupling element, i.e. the spring 6, now places itself around the bushing or sleeve 8 which is guided so as to be torsionally rigid on the axle of the pulley or rope drum 4, and which bushing or sleeve 8 has play in relation to the axle of the engaging element 5.

FIG. 4 further shows that the bushing or sleeve 8 essentially extends along the entire height or length of the elastic coupling element 6. In a way which is significant in the context of the invention, the height or length of the bushing or sleeve 8 approximately corresponds to the sum:

of the depth of the accommodation space 4C of the pulley or rope drum 4; and of the depth of the accommodation space 5A of the ratchet-type engaging element 5.

The required operating gap (design-related gap or design-related separation joint) between the axle of the pulley or rope drum 4 and the axle of the ratchet-type engaging element 5 no longer has any influence on the elastic coupling element 6. As a result, the tolerances can be larger, which in turn makes it possible to produce the starting device 100 more economically.

In order to limit the relative movement between the pulley or rope drum 4 and the ratchet-type engaging element 5 in the case of the first embodiment according to FIGS. 2, 3, 4, 5A, 5B, 6A, 6B and in this way to prevent any overload of the elastic coupling element 6, the angle of rotation by which the ratchet-type engaging element 5 is rotatable in relation to the pulley or rope drum 4 by exerting a load on the elastic coupling element 6, is limitable, in the starting operation of the first embodiment, to a specifiable maximum angular value in the magnitude of approximately 270 degrees to approximately 280 degrees. This provides good starting characteristics.

When this maximum angle of rotation in the magnitude of approximately 270 degrees to approximately 280 degrees has been reached, the spiral spring 6 places itself against the shaft, due to becoming smaller as a result of rotation. In the first embodiment according to FIGS. 2 to 6B, this placement of the spiral spring 6 against the shaft results in a blockage of any further rotation so that the ratchet-type engaging element 5 of the crankshaft is forced to rotate with the pulley or rope drum 4.

Figure 6A:
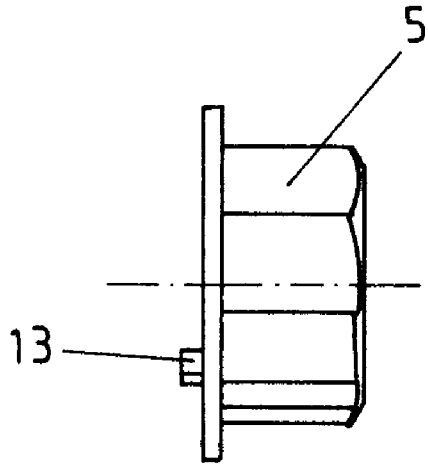
FIG. 6A is a diagrammatic lateral view of an embodiment of a (ratchet-type) engaging element according to the present invention, which engaging element is associated with the starting device shown in FIGS. 2 to 4, and in particular associated with the pulley or rope drum shown in FIGS. 5A and 5B.
Figure 6B:
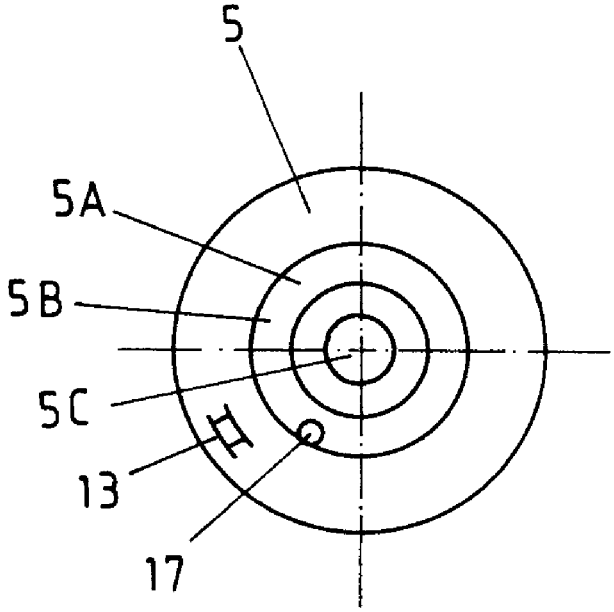
FIG. 6B is a diagrammatic top view of the (ratchet-type) engaging element shown in FIG. 6A.

Consequently, the maximum load of the elastic coupling element 6 can be specified in a simple and yet effective and reliable way. As shown in FIGS. 6A and 6B, in the first embodiment this is achieved by providing a limit stop 13 by means of which the angle of rotation of the ratchet-type engaging element 5 is limited in relation to the pulley or rope drum 4 in order to prevent, in this way, any overloading of the elastic coupling element 6 during tensioning into the block.

Apart from the limitation of the angle of rotation to maximum angular values to a magnitude of approximately 270 degrees to approximately 280 degrees when the starting device 100 is activated, i.e. when the handle 10 is pulled, there is a further significant technical effect in the case of the first embodiment of the starting device 100 in that as a result of the limit stop 13 forming itself to the underside of the ratchet-type engaging element 5 (outer flange of the ratchet-type engaging element 5), which underside faces the pulley or rope drum 4, an "emergency starting behavior" can be achieved in the (very unlikely) case of the elastic coupling element 6 breaking, which elastic coupling element 6 is arranged between the pulley or rope drum 4 and the ratchet-type engaging element 5, so that an easy-start system 100 with emergency starting characteristics is provided:

In this case of the elastic coupling element, namely the spiral spring 6, breaking, for the purpose of starting the internal combustion engine the load transfer means 9 (starter rope or pull rope) is tightened using the handle 10 (starter handle or pull handle) to such an extent that the limit stop 13 —really for the purpose of reaching the maximum angular value—contacts the rest surface 15 (compare FIGS. 5A and 5B) and by further pulling of the load transfer means 9 a normal or conventional starting process can be carried out.

Irrespective as to whether in regular operation (undamaged elastic coupling element 6) or in emergency operation (damaged elastic coupling element 6), the limit stop 13, which is in the form of a circular segment of arc-shaped segment, in the first embodiment according to FIGS. 2 to 6B, engages a guide groove 14 which is provided on the face of the pulley or rope drum 4 which faces the ratchet-type engaging element 5 in said pulley or rope drum 4 and makes possible for both components (ratchet-type engaging element 5 and pulley or rope drum 4) relative rotation of up to approximately 270 degrees to approximately 280 degrees in relation to each other before the path is limited by the circular segment or arc-shaped segment 13 coming to rest against the closed end 15 (limit stop buffer made from rubber-elastic material, the end of the rotary movement is stopped in a damped way) of the guide groove 14.

In order to limit the relative movement between the pulley or rope drum 4 and the ratchet-type engaging element 5 in the case of the second embodiment according to FIGS. 2, 3, 4, 7A, 7B, 8A, 8B and in this way to prevent any overload of the elastic coupling element 6, the angle of rotation by which the ratchet-type engaging element 5 is rotatable in relation to the pulley or rope drum 4 by exerting a load on the elastic coupling element 6, is limitable, in the starting operation of the second embodiment, to a specifiable maximum angular value in the magnitude of approximately 135 degrees to approximately 140 degrees. This provides good starting characteristics.

When this maximum angle of rotation in the magnitude of approximately 135 degrees to approximately 140 degrees has been reached, the spiral spring 6 places itself against the shaft, due to becoming smaller as a result of rotation. In the second embodiment according to FIGS. 2, 3, 4, 7A, 7B, 8A, 8B, this placement of the spiral spring 6 against the shaft results in a blockage of any further rotation so that the ratchet-type engaging element 5 of the crankshaft is forced to rotate with the pulley or rope drum 4.

Consequently, the maximum load of the elastic coupling element 6 can be specified in a simple and yet effective and reliable way. As sown in FIGS. 8A and 8B, in the second embodiment this is achieved by providing two limit stops 13, 13' by means of which the angle of rotation of the ratchet-type engaging element 5 is limited in relation to the pulley or rope drum 4 in order to prevent, in this way, any overloading of the elastic coupling element 6 during tensioning onto the block.

Unlike the first embodiment according to FIGS. 2-6B in which only one limit stop 13 is provided, the second embodiment according to FIGS. 2, 3, 4 and 7A-8B comprises two limit stops 13, 13' in order to achieve as even a load distribution as possible when the starting device 100 is activated, i.e. when the handle is pulled. This prevents any moment of tilt from being transferred to the associated components of the starting device 100.

Figure 8A:
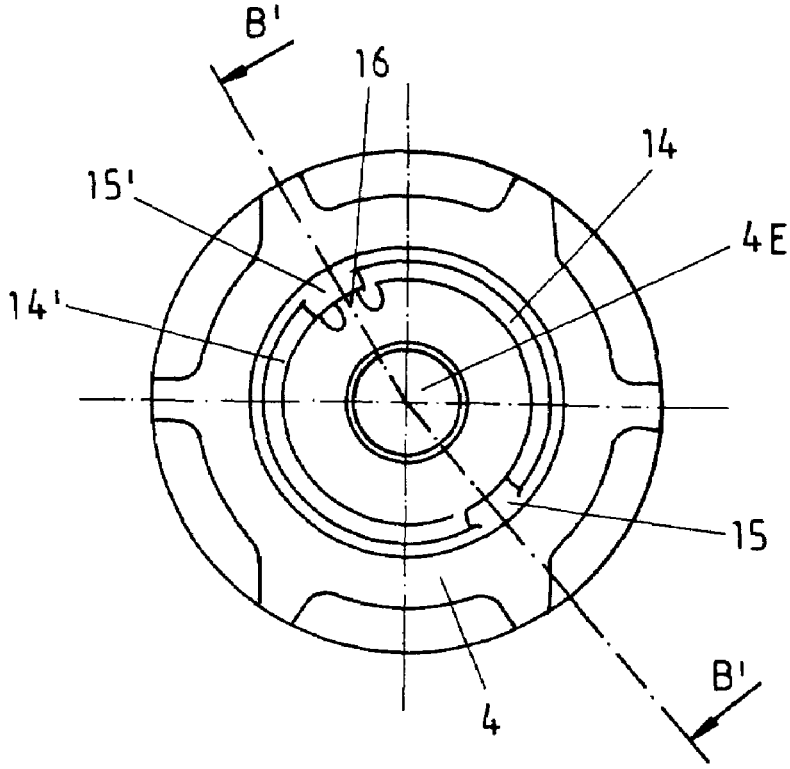
FIG. 8A is a diagrammatic lateral view of an embodiment of a (ratchet-type) engaging element according to the present invention, which engaging element is associated with the starting device shown in FIGS. 2 to 4, and in particular associated with the pulley or rope drum shown in FIGS. 7A and 7B.
Figure 8B:
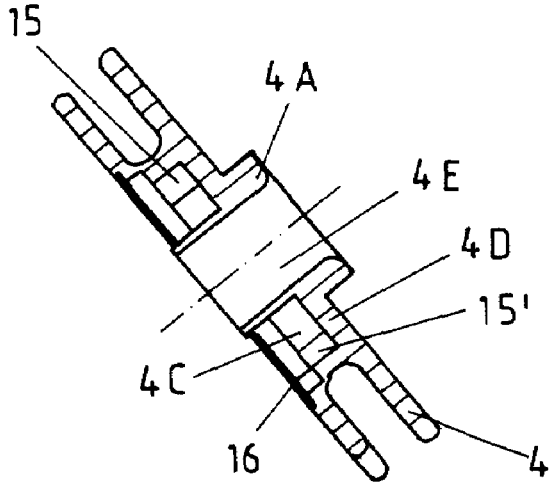
FIG. 8B is a diagrammatic top view of the (ratchet-type) engaging element shown in FIG. 8A.

In order to achieve the desired even load distribution in as precise a form as possible and in order to prevent any transfer of the moment of tilt to the involved components of the starting device 100 as completely as possible, the two limit stops 13, 13' in the second embodiment are essentially diametrically opposed to each other, i.e. they are arranged so as to be offset by approximately 180 degrees in relation to each other (compare FIGS. 8A and 8B).

Figure 7A:
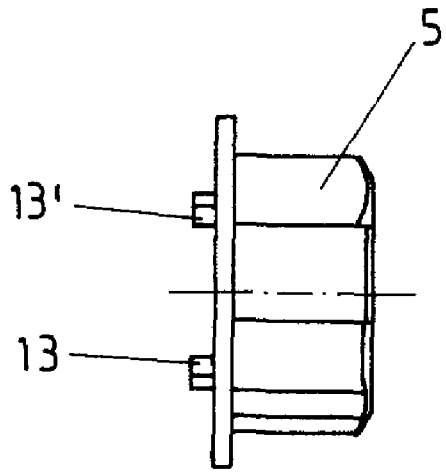
FIG. 7A is a diagrammatic top view of an embodiment which is an alternative to the embodiment shown in FIG. 5A, of a pulley or rope drum according to the present invention, with said pulley or rope drum being associated with the starting device shown in FIGS. 2 to 4.
Figure 7B:
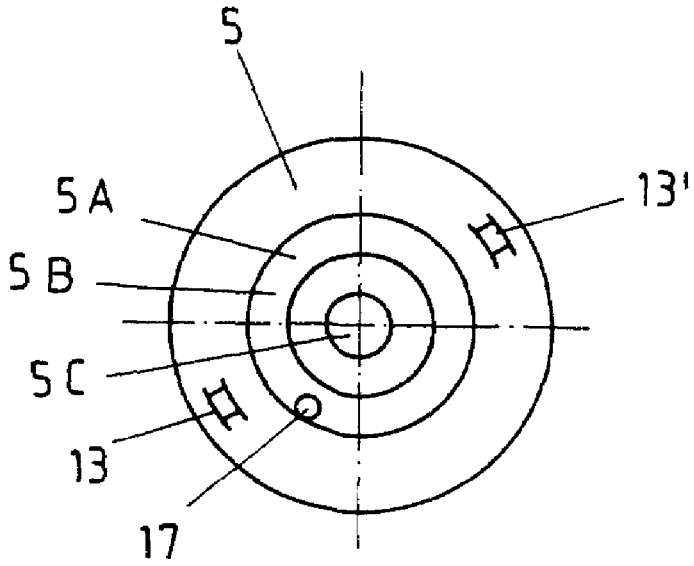
FIG. 7B is a diagrammatic section view of the pulley or rope drum shown in FIG. 7A along the sectional line B'-B' in FIG. 7A.

Accordingly, in the second embodiment, each of the two limit stops 13 or 13' is guided in a semicircular arc-shaped guide groove 14 or 14' (compare FIGS. 7A and 7B), wherein these two guide grooves 14, 14' are arranged so as to be essentially mirror inverted, i.e. arranged offset by approximately 180 degrees in relation to each other in the pulley or rope drum 4 (compare FIGS. 7A and 7B).

The above explanations show that if two limit stops 13, 13' (compare the second embodiment according to FIGS. 2, 3, 4 and 7A-8B) only half the maximum angular value is achieved in comparison to the use of one limit stop 13 (compare the fist embodiment according to FIGS. 2 to 6B). This fact of shorter (spring) travel and consequently a reduced load on the elastic coupling element 6 (resulting in less wear and increased service life) goes hand in hand with further technical advantages in that when two limit stops 13, 13' are used, not only is it possible to prevent the occurrence of moments of tilt, but it is also possible to transfer greater forces, which is of interest in particular in the case of motors with greater volumetric displacement.

Apart from the limitation of the angle of rotation to maximum angular values to a magnitude of approximately 135 degrees to approximately 140 degrees when the starting device 100 is activated, i.e. when the handle 10 is pulled, there is a further significant technical effect in the case of the second embodiment of the starting device 100 in that as a result of the two limit stops 13, 13' forming themselves to the underside of the ratchet-type engaging element 5 (outer flange of the ratchet-type engaging element 5), which underside faces the pulley or rope drum 4, an "emergency starting behavior" can be achieved in the (very unlikely) case of the elastic coupling element 6 breaking, which elastic coupling element 6 is arranged between the pulley or rope drum 4 and the ratchet-type engaging element 5, so that an easy-start system 100 with emergency starting characteristics is provided.

In this case of the elastic coupling element, namely the spiral spring 6, breaking, for the purpose of starting the internal combustion engine the load transfer means 9 (starter rope or pull rope) is tightened using the handle 10 (starter handle or pull handle) to such an extent that the two limit stops 13, 13' —really for the purpose of reaching the maximum angular value—contact the respective rest surfaces 15, 15' (compare FIGS. 7A and 7B) and by further pulling of the load transfer means 9 a normal or conventional starting process can be carried out.

Irrespective as to whether in regular operation (undamaged elastic coupling element 6) or in emergency operation (damaged elastic coupling element 6), each of the two limit stops 13 or 13', which is in the form of a circular segment or arc-shaped segment, in the second embodiment according to FIGS. 2, 3, 4 and 7A-8B, engage a guide groove 14 or 14' which is provided on the face of the pulley or rope drum 4 which faces the ratchet-type engaging element 5 in said pulley or rope drum 4 and makes possible for both components (ratchet-type engaging element 5 and pulley or rope drum 4) relative rotation of up to approximately 135 degrees to approximately 140 degrees in relation to each other before the path is limited by the circular segment or arc-shaped segment 13 or 13' coming to rest against the closed end 15 or 15' (limit stop buffer made from rubber-elastic material, thus the end of the rotary movement is stopped in a damped way) of the guide groove 14 or 14'.

In this arrangement the two limit stops 13 or 13' in the second embodiment, for the purpose of achieving the maximum angular value, contact the rest surfaces 15 or 15' simultaneously at the end of the respective guide groove 14 or 14', so that the desired even load distribution is implemented in a particularly precise form and so that any transfer of the moment of tilt to the involved components of the starting device 10 is completely prevented.

As a result of this type of design of the starting device 100 according to FIGS. 2 to 8B, the travel of the elastic coupling element 6 (spring travel) or the angle of rotation is controlled in a targeted way, i.e. the elastic coupling element 6 now only absorbs the force up to the end of travel and consequently is no longer overloaded when it places itself against the shaft—which of course also has a positive effect on the service life of the elastic coupling element 6.

If the elastic coupling element 6, i.e. the spiral spring, breaks nevertheless, the starting device 100 loses its comfortable damping characteristics during the starting process; however, the operator continues to be able to start the internal combustion engine.

Consequently, in the present starting device 100, the following are of essential importance in that during breakage of the elastic coupling element 6 it is no longer the case that the entire work tool, for example the entire chainsaw, ceases to function:

the provision of the limit stop 13 in the case of the first embodiment according to FIGS. 2-6B; or the provision of the two limit stops 13, 13' in the case of the second embodiment according to FIGS. 2, 3, 4 and 7A-8B.

Instead, the provision of:

the limit stop 13 in the case of the first embodiment according to FIGS. 2-6B; or the two limit stops 13, 13' in the case of the second embodiment according to FIGS. 2, 3, 4, and 7A-8B ensures that if the spiral spring 6 breaks, only the basically desired soft pulling behavior during the starting process is lost, while the starting device 100 —after overcoming the "idle" up to the limit stop—is operable like a normal starter. Accordingly, operators can determine a convenient time for repair (exchanging the broken elastic coupling element 6) without being hindered in their work or being forced into an inconvenient interruption of their work.

If the reaction torque, after the dead centre position of the motor piston has been exceeded, again fails to achieve the specified limiting value, then the elastic coupling element 6 relaxes again up to its home position, wherein the ratchet-type engaging element 5, which is being taken along by the coupling element 6, moves in the direction of rotation, relative to the pulley or rope drum 4.

The elastic coupling element 6 thus at the same time acts as an energy store which gives off the energy, which has been stored during the just completed deformation, to the ratchet-type engaging element 5 such that it temporarily reaches a higher absolute rotary speed than does the pulley or rope drum 4, before again rotating at the speed of said pulley or rope drum 4.

The starter spring 2 has been provided to return the pulley or rope drum 4 to its home position so that the starter rope or pull rope 9, having been pulled out, is subsequently rewound onto the pulley or rope drum 4 as is customary in pull-rope type starting devices. Since the spring housing 3 is covered by the (metal) disc 3A, there is only a small amount of friction between the spring housing 3 and the pulley or rope drum 4 when said pulley or rope drum 4 is rotated.

Most of the components of the starting device 100 according to FIGS. 2 to 8B are made from plastic materials, including for example the housing 1, the spring housing 3, the pulley or rope drum 4, as well as the ratchet-type engaging element 5. The elastic coupling element 6 is made from flat steel strip, while the metal of the installed bushing or sleeve 8 is hardened. Not least due to the above-mentioned selection of materials, production and installation of the starting device 100 according to the present invention are particularly cost-effective.

Finally, reference is made to the characteristic which is significant to the context of the invention, and which is connected with the above-mentioned explanations, or is independent of the above-mentioned explanations wherein the elastic coupling element 6, i.e. the spiral spring, is pretensioned, i.e. can comprise pretension, both in the first embodiment according to FIGS. 2-6B and in the second embodiment according to FIGS. 2, 3, 4, and 7A-8B.

Among other things, this results in a positive technical effect in that already at the very start of the rotary movement between the pulley or rope drum 4 and the ratchet-type engaging element 5, transfer of force by way of the elastic coupling element 6 can start, and/or the forces which can be transferred by way of the elastic coupling element 6 can be greater because a region of the characteristic curve o the elastic coupling element 6, i.e. of the spring characteristic curve, can be exploited, which region differs from that of the state of the art.

In a particularly synergetic way, installation of the elastic coupling element 6, which is pretensioned, or which comprises pretension, can be combined with the above-described provision of a limit stop 13 by means of which the angle of rotation of the ratchet-type engaging element 5 relative to the pulley or rope drum 4 can be limited to a maximum angle of rotation in the magnitude of approximately 270 degrees to approximately 280 degrees (first embodiment according to FIGS. 2 to 6B); or two limit stops 13 and 13' by means of which the angle of rotation of the ratchet-type engaging element 5 relative to the pulley or rope drum 4 can be limited to a maximum angle of rotation in the magnitude of approximately 135 degrees to approximately 140 degrees (second embodiment according to FIGS. 2, 3, 4, and 7A-8B).

Although several embodiments have been described in some detail for purposes of illustration, various modifications may be made without departing from the scope and spirit of the invention. Accordingly, the invention is not to be limited, except as by the appended claims.

What is claimed is:

1. A pull-rope starting device (100) for an internal combustion engine, which comprises a rope drum (4) rotatably held in a housing (1), wherein said starting device, for generating the drive torque for a motor shaft by means of at least one starter handle (10) is rotatable by way of a load transfer means (9) and by way of an elastic coupling element (6) comprising a spiral spring, is connected to a ratchet-type engaging element (5) by means of which the drive torque can be transmitted to the motor shaft, characterised in that in a gap between a) an axle of the rope drum (4), and b) an axle of the engaging element (5), at least one thin-walled bushing or sleeve (8) is disposed between the elastic coupling element and the gap between the axles of the rope drum and the engaging element, preventing the coupling element from entering the gap.

2. The starting device according to claim 1, wherein the bushing or sleeve (8) is guided so as to be torsionally rigid on the axle of the pulley or rope drum (4).

3. The starting device according to claim 1, wherein the bushing or sleeve (8) has play in relation to the axle of the engaging element (5).

4. The starting device according to claim 1, wherein the bushing or sleeve (8) is in the shape of a hollow cylinder and can be put over opposite ends of a drum shaft or the motor shaft, so that the coupling element (6) does not become deformed.

5. The starting device according to claim 4, wherein the bushing or sleeve (8) generally extends along an entire length of the coupling element (6).

6. The starting device according to claim 1, wherein when the starting device (100) is activated, in particular when the handle (10) is pulled, the coupling element (6) places itself around the bushing or sleeve (8).

7. The starting device according to claim 1, wherein the bushing or sleeve (8) is comprised of a hardened metal.

8. The starting device according to claim 1, wherein the gap between the rope drum (4), in particular between the axle of the rope drum (4), and the coupling element (6), or between the rope drum (4), in particular the axle of the rope drum (4), and the engaging element (5), in particular the axle of the engaging element (5) is in the shape of at least one design-related gap or in the shape of at least one design-related separation joint.

9. The starting device according to claim 1, wherein the coupling element (6) is pretensioned.

10. An internal combustion engine, in particular a two-stroke or four-stroke motor, characterised by at least one starting device (100) according to claim 1.

11. A portable hand tool characterised by at least one internal combustion engine according to claim 10, which internal combustion engine comprises at least one starting device (100) equipped according to claim 1.

12. A pull-rope starting device (100) for an internal combustion engine, which comprises a rope drum (4) rotatably held in a housing (1), wherein said starting device, for generating the drive torque for a motor shaft by means of at least one starter handle (10) is rotatable by way of a load transfer means (9) and by way of an elastic coupling element (6) comprising a spiral spring, is connected to a ratchet-type engaging element (5) by means of which the drive torque can be transmitted to the motor shaft, characterised in that in a gap between a) an axle of the rope drum (4), and b) an axle of the engaging element (5), at least one thin-walled bushing or sleeve (8) is disposed between the elastic coupling element and the gap between the axles of the rope drum and the engaging element, preventing the coupling element from entering the gap;

wherein the bushing or sleeve (8) is guided so as to be torsionally rigid on the axle of the pulley or rope drum (4) and has play in relation to the axle of the engaging element (5).

13. The starting device according to claim 12, wherein the bushing or sleeve (8) is in the shape of a hollow cylinder and can be put over opposite ends of a drum shaft or the motor shaft, so that the coupling element (6) does not become deformed.

14. The starting device according to claim 13, wherein the bushing or sleeve (8) generally extends along an entire length of the coupling element (6).

15. The starting device according to claim 12, wherein when the starting device (100) is activated, in particular when the handle (10) is pulled, the coupling element (6) places itself around the bushing or sleeve (8).

16. The starting device according to claim 12, wherein the bushing or sleeve (8) is comprised of a hardened metal.

17. The starting device according to claim 12, wherein the gap between the rope drum (4), in particular between the axle of the rope drum (4), and the coupling element (6), or between the rope drum (4), in particular the axle of the rope drum (4), and the engaging element (5), in particular the axle of the engaging element (5) is in the shape of at least one design-related gap or in the shape of at least one design-related separation joint.

18. The starting device according to claim 12, wherein the coupling element (6) is pretensioned.

19. An internal combustion engine, in particular a two-stroke or four-stroke motor, characterised by at least one starting device (100) according to claim 1.

20. A portable hand tool characterised by at least one internal combustion engine according to claim 19, which internal combustion engine comprises at least one starting device (100) equipped according to claim 1.

* * * * *